US009042084B2

(12) United States Patent
Pever et al.

(10) Patent No.: US 9,042,084 B2
(45) Date of Patent: May 26, 2015

(54) SYSTEMS AND METHODS FOR ELECTRICALLY CONNECTING CIRCUIT DEVICES FOR POWER DISTRIBUTION ENCLOSURES

(71) Applicants: Steven E. Pever, Spartanburg, SC (US); Timothy J. Fink, Woodruff, SC (US); Karthik Chandran Krishnamurthy, Greenville, SC (US); Raymond Jadin, Lexington, SC (US)

(72) Inventors: Steven E. Pever, Spartanburg, SC (US); Timothy J. Fink, Woodruff, SC (US); Karthik Chandran Krishnamurthy, Greenville, SC (US); Raymond Jadin, Lexington, SC (US)

(73) Assignee: Siemens Industry, Inc., Alpharetta, GA (US)

( * ) Notice: Subject to any disclaimer, the term of this patent is extended or adjusted under 35 U.S.C. 154(b) by 314 days.

(21) Appl. No.: 13/708,181

(22) Filed: Dec. 7, 2012

(65) Prior Publication Data

US 2014/0160638 A1 Jun. 12, 2014

(51) Int. Cl.

| | |
|---|---|
| ***H01H 9/02*** | (2006.01) |
| ***H01R 4/34*** | (2006.01) |
| ***H01H 71/08*** | (2006.01) |
| *H01R 4/56* | (2006.01) |

(52) U.S. Cl.

CPC ..... *H01R 4/34* (2013.01); *H01H 71/08* (2013.01); *H01R 4/56* (2013.01)

(58) Field of Classification Search

CPC ..... H01H 9/02; H05K 7/20; H02B 1/20; H02B 1/04; H01R 4/66; H01R 13/46

USPC ..... 361/355, 643, 648, 676, 652, 704; 106/287.2; 339/14; 439/813; 174/136

See application file for complete search history.

(56) References Cited

U.S. PATENT DOCUMENTS

| | | | | |
|---|---|---|---|---|
| 4,251,851 | A * | 2/1981 | Diersing et al. | 361/652 |
| 5,131,856 | A * | 7/1992 | Auclair | 439/100 |
| 5,518,351 | A * | 5/1996 | Peil | 411/383 |
| 6,459,570 | B1 * | 10/2002 | Buchanan | 361/648 |
| 6,530,811 | B1 * | 3/2003 | Padulo et al. | 439/716 |
| 6,559,387 | B1 * | 5/2003 | Franks | 174/136 |
| 6,864,015 | B2 * | 3/2005 | Peterson et al. | 429/182 |
| 7,142,950 | B2 * | 11/2006 | Rasmussen et al. | 700/286 |
| 2004/0090029 | A1 * | 5/2004 | Hardesty | 280/79.11 |
| 2007/0279844 | A1 * | 12/2007 | Zhang et al. | 361/676 |
| 2012/0135867 | A1 * | 5/2012 | Thom et al. | 505/210 |
| 2012/0152705 | A1 * | 6/2012 | Nakano et al. | 200/293 |
| 2012/0182680 | A1 * | 7/2012 | Wetzel et al. | 361/679.06 |

* cited by examiner

*Primary Examiner* — Robert J Hoffberg
*Assistant Examiner* — Matt Dhillon

(57) ABSTRACT

A system is provided for a power distribution enclosure that includes an electronic circuit component. The system includes a conductive adapter having a head, and a circuit breaker base adapted for mounting to the power distribution enclosure. The circuit breaker base has an aperture adapted to receive the head of the conductive adapter. The head of the conductive adapter has a shape that substantially prevents rotation of the conductive adapter when the conductive adapter is inserted into the aperture. The conductive adapter is configured to draw away or absorb heat from the electronic circuit component and move the absorbed heat out of the power distribution enclosure. The circuit breaker base is adapted to substantially prevent heat from escaping from the conductive adapter into the power distribution enclosure. Numerous other aspects are provided.

21 Claims, 16 Drawing Sheets

SYSTEMS AND METHODS FOR ELECTRICALLY CONNECTING CIRCUIT DEVICES FOR POWER DISTRIBUTION ENCLOSURES

BACKGROUND

This invention relates to electrical power distribution systems. More particularly, this invention relates to systems and methods for electrically connecting circuit devices for power distribution enclosures.

SUMMARY

In a first aspect of the invention, a system is provided for a power distribution enclosure that includes an electronic circuit component. The system includes a conductive adapter having a head, and a circuit breaker base adapted for mounting to the power distribution enclosure. The circuit breaker base has an aperture adapted to receive the head of the conductive adapter. The head of the conductive adapter has a shape that substantially prevents rotation of the conductive adapter when the conductive adapter is inserted into the aperture. The conductive adapter is configured to draw away or absorb heat from the electronic circuit component and move the absorbed heat out of the power distribution enclosure. The circuit breaker base is adapted to substantially prevent heat from escaping from the conductive adapter into the power distribution enclosure.

In a second aspect of the invention, a system is provided for a power distribution enclosure. The system includes a conductive adapter having a head, and a neutral bracket adapted for mounting to the power distribution enclosure. The neutral bracket includes an aperture adapted to receive the head of the conductive adapter. The head of the neutral bracket has a shape that substantially prevents rotation of the conductive adapter when the conductive adapter is inserted into the aperture. The neutral bracket is adapted to substantially prevent heat from escaping from the conductive adapter into the power distribution enclosure.

In a third aspect of the invention, a method is provided for configuring a power distribution enclosure that includes an electronic circuit component. The method includes providing a plurality of conductive adapters, each conductive adapter having a head, providing a circuit breaker base having a plurality of apertures, each aperture adapted to receive the head of one of the conductive adapters, inserting one or more of the conductive adapters into a corresponding one or more of the apertures, and mounting the circuit breaker base to the power distribution enclosure. The head of each conductive adapter has a shape that substantially prevents rotation of the conductive adapter in the aperture. The conductive adapters are configured to draw away or absorb heat from the electronic circuit component and move the absorbed heat out of the power distribution enclosure. The circuit breaker base is adapted to substantially prevent heat from escaping from the conductive adapters into the power distribution enclosure.

Other features and aspects of the present invention will become more fully apparent from the following detailed description, the appended claims and the accompanying drawings.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION

Systems and methods in accordance with this invention include or provide a conductive adapter, a circuit breaker base and a neutral bracket for electrically connecting circuit devices for power distribution enclosures, such as busway systems including but not limited to busplugs, tap boxes, cubicles, transformer throats and other similar power distribution enclosures. As described in more detail below, conductive adapters in accordance with this invention are multifunctional components that may be configurably used with any conductive or insulating device, such as circuit breaker bases and neutral brackets to accommodate a variety of electrical components and provide various circuit configurations.

Conductive Adapter

Figure 1B:
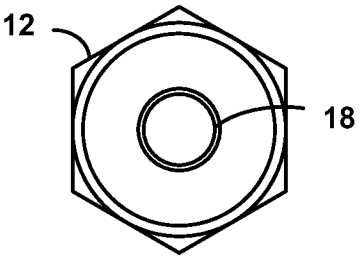
FIGS. 1A-1C are views of an example conductive adapter in accordance with this invention.
Figure 1C:
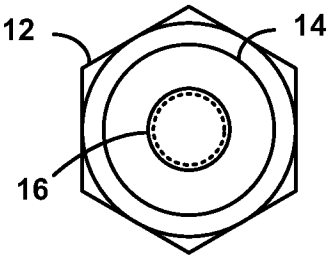
Figure 1A:
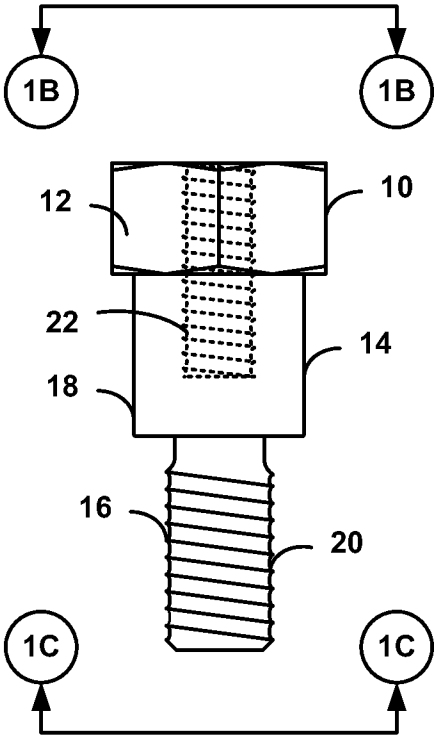

Referring to FIGS. 1A-1C, an example conductive adapter 10 in accordance with this invention is described. Conductive adapter 10 includes a head 12, a shaft 14 and a shank 16. As described in more detail below, head 12 has a shape that substantially prevents rotation of conductive adapter 10 when conductive adapter 10 is inserted into a corresponding aperture in breaker bases and neutral brackets in accordance with this invention. For example, head 12 may have a hexagonal shape, as shown in FIGS. 1A-1C. Alternatively, head 12 may have a triangular, quadrilateral, pentagonal, octagonal, or other similar polygonal shape.

Shaft 14 is cylindrical or polygonal in shape and has a generally smooth outer surface 18. Shank 16 has external threads 20. As shown in FIG. 1A, conductive adapter 10 optionally may include an internally-threaded bore 22 that extends through head 12 and through a portion of shaft 14. Persons of ordinary skill in the art will understand that bore 22 alternatively may extend only into head 12, or may extend through head 12, shaft 14 and a portion of shank 16.

As described in more detail below, conductive adapter 10 may be used to provide electrical connectivity and heat dissipation for components in a power distribution enclosure, such as busway systems including but not limited to busplugs, tap boxes, cubicles, transformer throats and other similar power distribution enclosures.

Accordingly, conductive adapter 10 preferably is fabricated from a material having low resistivity and high thermal conductivity, such as copper, bronze, aluminum, brass, stainless steel, gold, silver, platinum or other similar material. In addition, conductive adapter 10 may be plated with another metal material to improve corrosion resistance, solderability, hardening, or other similar purpose. For example, conductive adapter 10 may plated with gold, silver, zinc, tin or other similar metal material.

Conductive adapter 10 may be fabricated in any desired dimensions. For example, conductive adapter 10 may have a length between about 1.0 cm and about 60 cm, head 12 may have a hex shape and a diameter between about 0.5 cm and about 3.0 cm, shaft 14 may have a diameter between about 0.25 cm and about 2.5 cm and a length between about 0.25 cm and about 45 cm, shank 16 may have a diameter between about 0.2 cm and about 2.0 cm and a length between about 0.25 cm and about 15.0 cm, and internally-threaded bore 22 may have a length between about 0.5 cm and 60 cm. Persons of ordinary skill in the art will understand that other dimensions may be used.

Systems in accordance with this invention may be used to manage heat generated in the presence of a current load. In example embodiments of this invention, conductive adapter 10 may be sized to scavenge (e.g., draw away or absorb) heat from a circuit breaker (circuit breakers may generate significant heat in power distribution enclosures) and move the absorbed heat to line side conductors and ultimately out of the power distribution enclosure.

For example, conductive adapter 10 may be sized relative to (approximately proportional to) the systems' electrical capacity. Table 1, below, lists example dimensions of a conductive adapter 10 fabricated from ETP copper C11000 material for a variety of system capacities:

TABLE 1

Example Conductive Adapter Dimensions
ETP Copper C11000 Material

| System Capacity (Amps) | Length (cm) | Shaft Diameter (cm) |
|---|---|---|
| 48 | 1.7 | 0.825 |
| 80 | 1.7 | 1.156 |
| 150 | 1.12 | 1.54 |

Persons of ordinary skill in the art will understand that other system capacities, dimensions, and conductive materials may be used.

As described in more detail below, the geometry and insulating characteristics of circuit breaker bases and neutral brackets in accordance with this invention may be matched (e.g., tailored) to the determined geometry of conductive adapter 10, and subject to physical limits of the selected materials.

In addition, in example embodiments of this invention, conductive adapter 10 may be sized to pass current through a plane from a top surface to a bottom surface with both top and bottom surface disposed a predetermined distance (e.g., +0.0254 cm, or other similar dimension) from respective top and bottom surfaces of circuit breaker bases and neutral brackets in accordance with this invention.

Circuit Breaker Base

Referring now to FIGS. 2A-2D, an example circuit breaker base 30 in accordance with this invention is described. Circuit breaker base 30 includes a tray 32 having a first edge 34, a second edge 36, first and second end tabs 38*a* and 38*b* at either end of tray 32, and a raised lip 40 disposed adjacent second edge 36. Tray 32 includes apertures 42*a*-42*f* that extend from a top side 44 to a bottom side 46 of tray 32, and baffles 48 disposed between apertures 42*a*-42*f*. Example circuit breaker base 30 includes six apertures 42*a*-42*f* and seven baffles 48. Persons of ordinary skill in the art will understand that circuit breaker bases 30 in accordance with this invention may include more or less than six apertures 42*a*-42*f* and more or less than seven baffles 48.

Figure 2A:
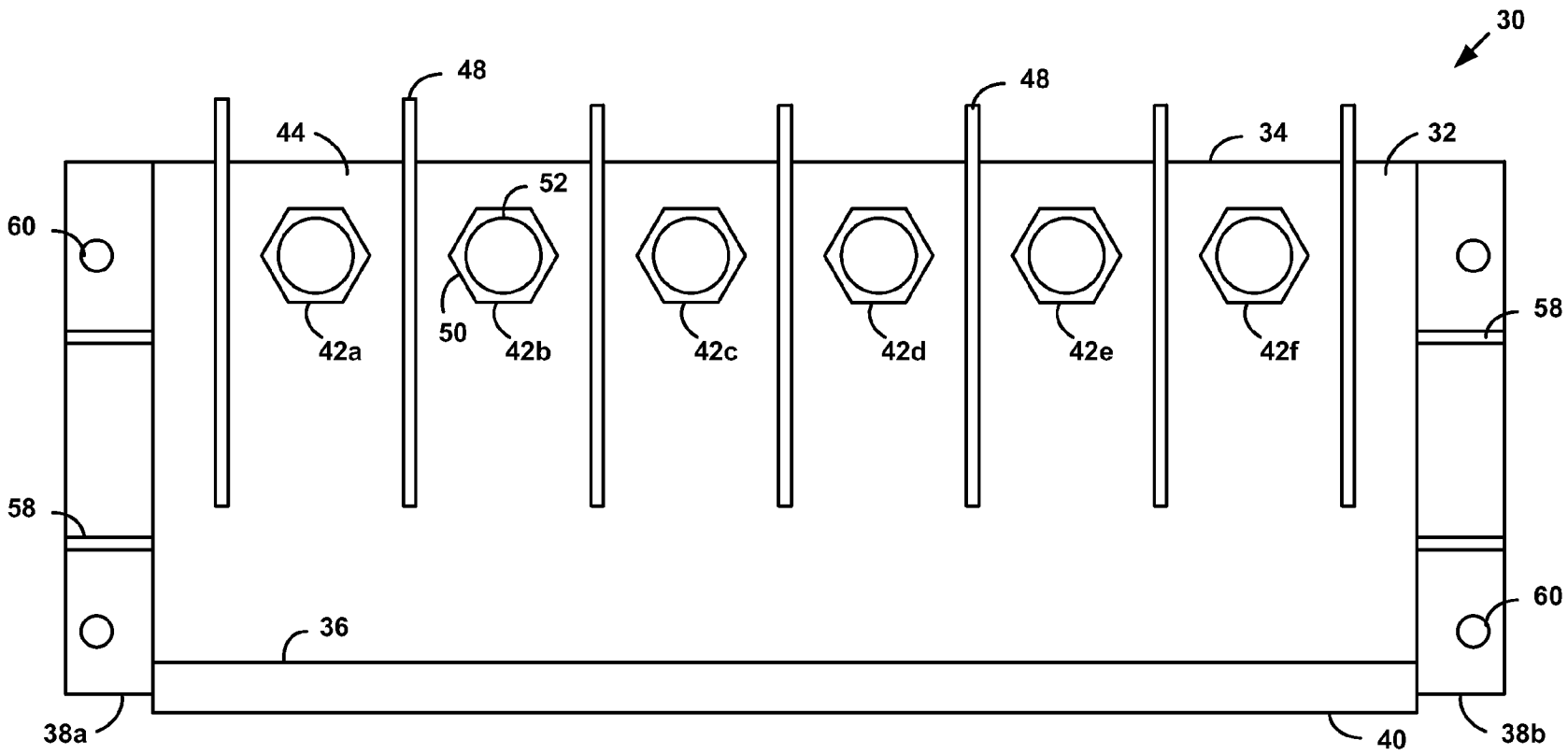
FIGS. 2A-2D are views of an example circuit breaker base in accordance with this invention.

Each aperture 42*a*-42*f* has a size and shape adapted to receive a conductive adapter 10 (FIGS. 1A-1C). For example, as shown in FIG. 2A, each aperture 42*a*-42*f* has a first portion 50 having a hexagonal shape adapted to receive hexagonal head 12, and a second portion 52 having a cylindrical shape adapted to receive cylindrical shaft 14. Apertures 42*a*-42*f* are sized so that head 12 and cylindrical shaft 14 snugly fit first portion 50 and second portion 52, respectively. In this regard, a conductive adapter 10 may be press-fit or provide alternate fit conditions in which retention is achieved into an aperture 42*a*-42*f*. This may facilitate single handed insertion of conductive adapters 10 into apertures 42*a*-42*f*. In addition, the shape of first portion 50 and second portion 52 substantially prevents rotation of an inserted conductive adapter 10.

Baffles 48 project from top side 44 and bottom side 46 of tray 32, and wrap around and extend from first edge 34 of tray 32. In particular, as shown in FIG. 2D, each baffle 48 includes a first portion 54 that projects from top side 44, and a second portion 56 that projects from bottom side 46. As described in more detail below, first portions 54 of baffles 48 are sized to fit within corresponding slots of circuit breakers mounted on tray 32.

In addition, baffles 48 separate and provide electrical isolation between adjacent apertures 42*a*-42*f*, and also separate and guide gaseous emissions from circuit breakers (not shown in FIGS. 2A-2D). As will be understood by persons of ordinary skill in the art, baffles 48 may be sized in accordance with electrical safety clearance and spacing requirements. Persons of ordinary skill in the art will understand that baffles 48 may have shapes other than those shown in FIGS. 2A-2D.

Figure 2B:
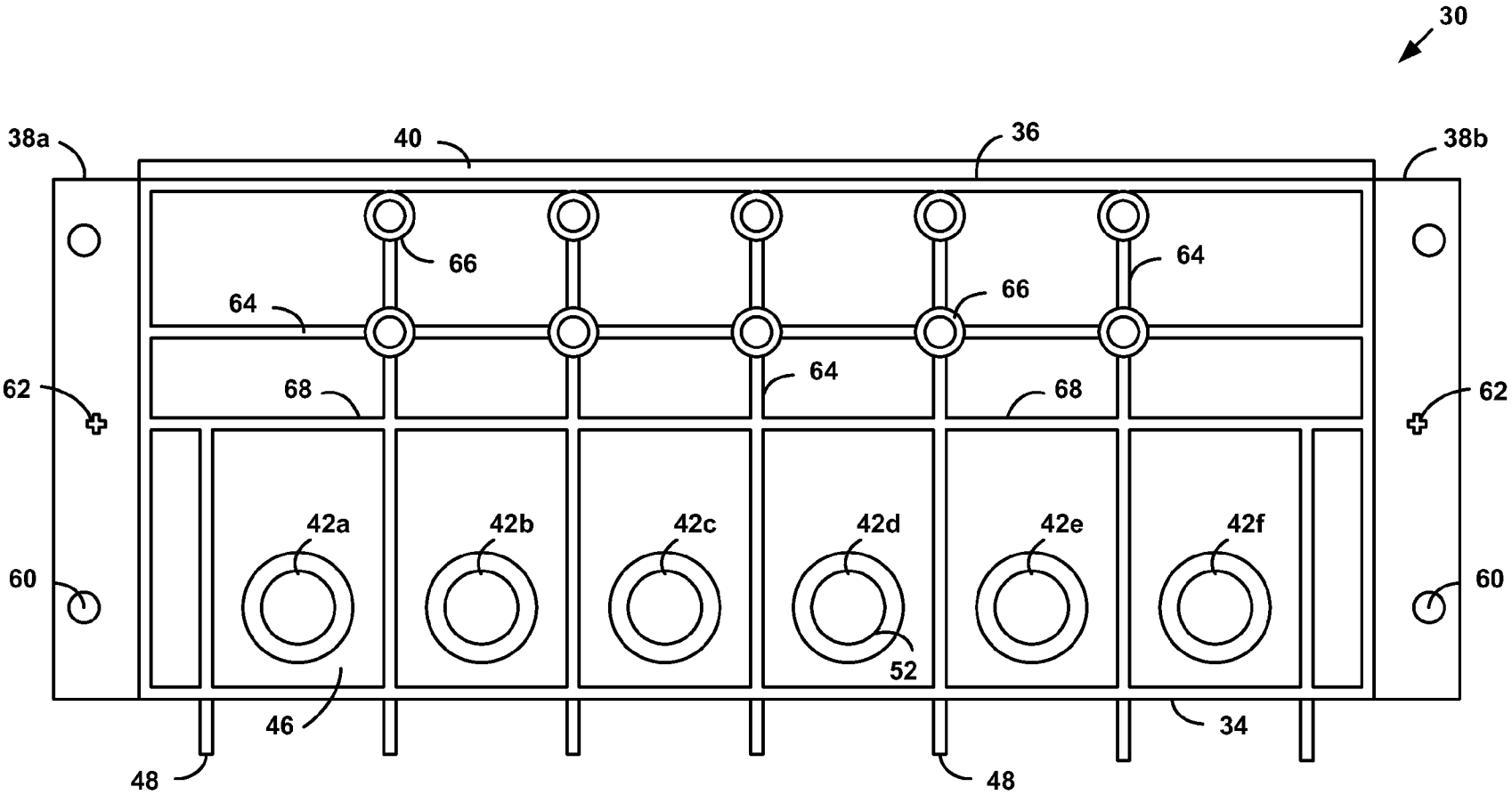
Figure 2C:
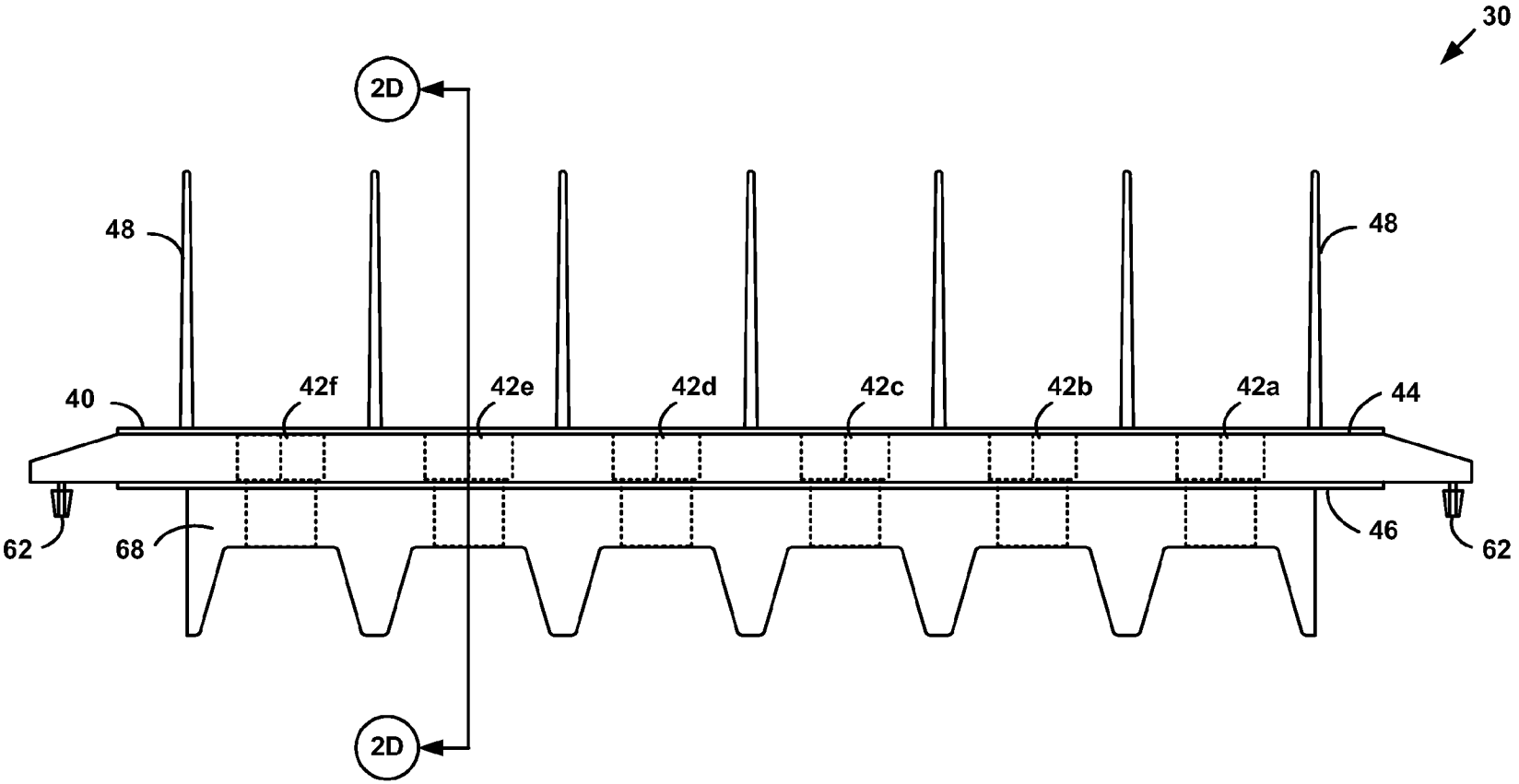
Figure 2D:
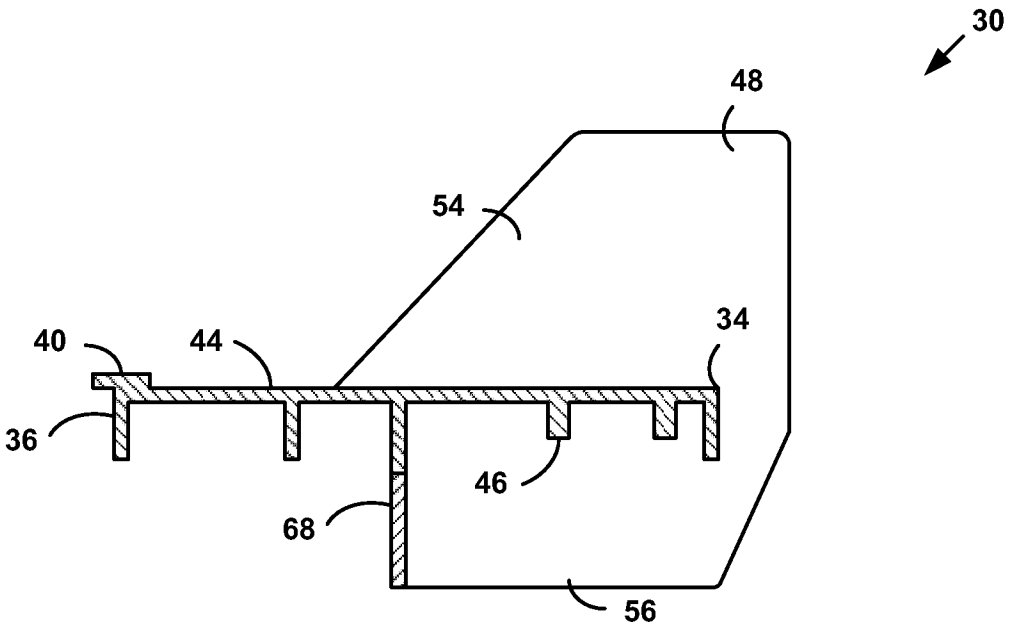

As shown in FIGS. 2A-2B, first and second end tabs 38*a* and 38*b* include struts 58 for structural rigidity, and apertures 60, which may be used to attach circuit breaker base 30 to an interior compartment of a power distribution enclosure, such as a bus plug (not shown in FIGS. 2A-2D).

In addition, as shown in FIGS. 2B-2C, first and second end tabs 38*a* and 38*b* includes tapered plugs 62 that may snap into corresponding apertures (not shown) of a power distribution enclosure. In this regard, tapered plugs 62 may be used to hold circuit breaker base 30 in place so that an installer may then insert fasteners through apertures 60 to securely attach circuit breaker base 30 to the power distribution enclosure.

As shown in FIGS. 2A and 2D, raised lip 40 projects from top side 44 of tray 32. As described in more detail below, raised lip 40 may engage a corresponding recess on a back side of one or more circuit breakers (not shown) installed in circuit breaker base 30.

As shown in FIG. 2B, bottom side 46 of tray 32 includes struts 64 for structural rigidity, and apertures 66, which may be internally threaded and used to attach accessories (not shown) to tray 32. Although bottom side 46 of tray 32 includes ten apertures 66, persons of ordinary skill in the art will understand that more or less than ten apertures 66 may be used. As shown in FIG. 2D, second portion 56 of baffles 48 terminate at end face 68, which also adds structural rigidity to tray 32.

Circuit breaker base 30 preferably is fabricated from a high strength, electrically and thermally insulating material such as plastic, resin, reinforced paper, phenolic, reinforced plastic, ceramic, porcelain or other similar material. Circuit breaker base 30 may be a single component, or may be made of multiple combined components, and may be fabricated by injection molding, machining, layered sintering or fusion, or other similar process.

Circuit breaker base 30 may be fabricated in any desired dimensions. For example, circuit breaker base 30 may have an overall length between about 2.5 cm and about 50 cm, an overall width between about 2.5 cm and about 25 cm, and an overall thickness between about 0.2 cm and about 2.0 cm. Persons of ordinary skill in the art will understand that other dimensions may be used.

The geometry and insulating characteristics of circuit breaker base 30 may be matched (e.g., tailored) to the determined geometry of conductive adapter 10, and subject to physical limits of the selected materials. For example, Table 2, below, lists example dimensions of features of circuit breaker base 30 fabricated from 10% glass filled MPPE-PS thermoplastic polymer material and tailored to the dimensions of conductive adapter 10 from Table 1, above:

TABLE 2

Example Circuit Breaker Base Dimensions
10% Glass Filled MPPE-PS Thermoplastic Polymer Material

| System Capacity (Amps) | Aperture Length (cm) | Aperture (42a-42f) Wall Thickness (cm) |
|---|---|---|
| 48 | 1.625 | 0.195 |
| 80 | 1.625 | 0.228 |
| 150 | 1.070 | 0.285 |

Persons of ordinary skill in the art will understand that other system capacities, dimensions, and insulating materials may be used, and that other fill ratios and material types may be used.

Figure 3A:
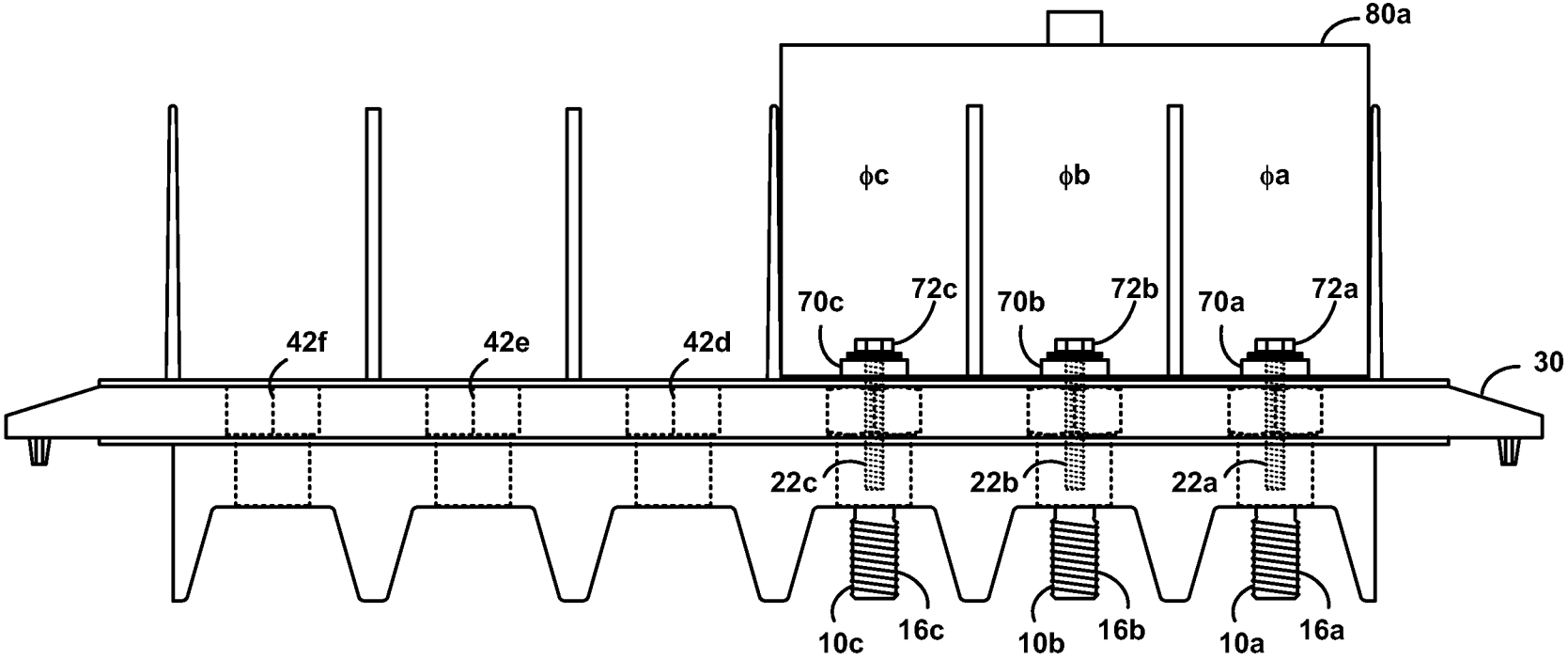
FIGS. 3A-3F are views of example configurations in accordance with this invention of the conductive adapter of FIGS. 1A-1C and the circuit breaker base of FIGS. 2A-2D.
Figure 3B:
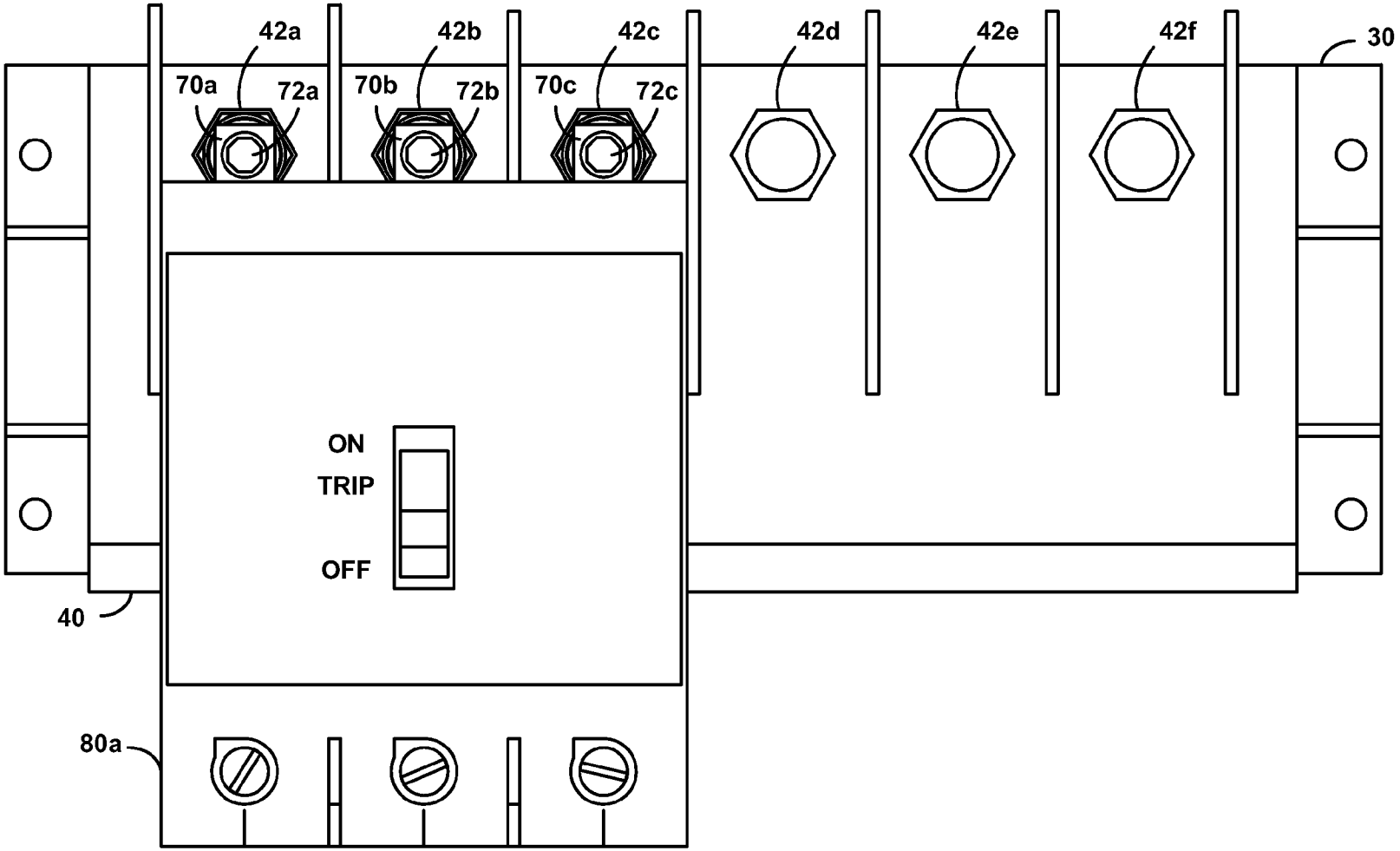

As described above, conductive adapters and circuit breaker bases in accordance with this invention, such as example conductive adapter 10 and example circuit breaker base 30, may be used with one or more circuit breakers, including one or more single-pole, two-pole, three-pole, or other similar circuit breakers. For example, FIGS. 3A-3B illustrate an example configuration in which conductive adapters 10*a*-10*c* are inserted into apertures 42*a*-42*c*, respectively, of circuit breaker base 30, and a three-pole circuit breaker 80*a* is mounted on circuit breaker base 30 and coupled to conductive adapters 10*a*-10*c*.

Circuit breaker 80*a* may include conductive tabs 70*a*-70*c* that are coupled to poles ϕa-ϕc, respectively, of circuit breaker 80*a*. Conductive tabs 70*a*-70*c* may be copper, or other similar conductive material. Fasteners 72*a*-72*c* are inserted into openings in conductive tabs 70*a*-70*c*, respectively, and into internally threaded bores 22*a*-22*c*, respectively, of conductive adapters 10*a*-10*c*, respectively. Fasteners 72*a*-72*c* may be bolts, screws, or other similar fasteners.

Circuit breaker 80*a* may include a recess (not shown) that engages and rests on raised lip 40 of circuit breaker base 30. Although not shown in FIGS. 3A-3B, conductors may be coupled to shanks 16*a*-16*c* of conductive adapters 10*a*-10*c*, respectively, to make line-side connections to poles ϕa-ϕc, respectively, of circuit breaker 80*a*.

Figure 3C:
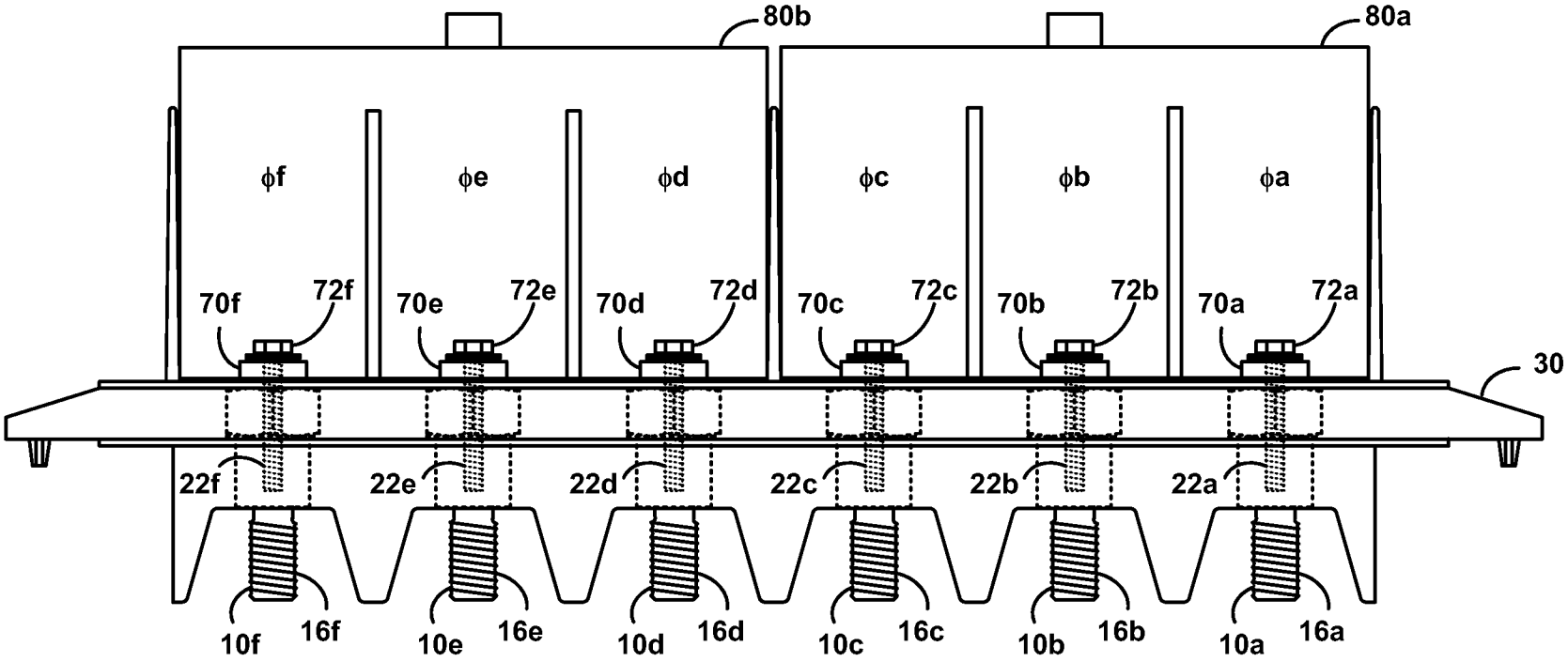
Figure 3D:
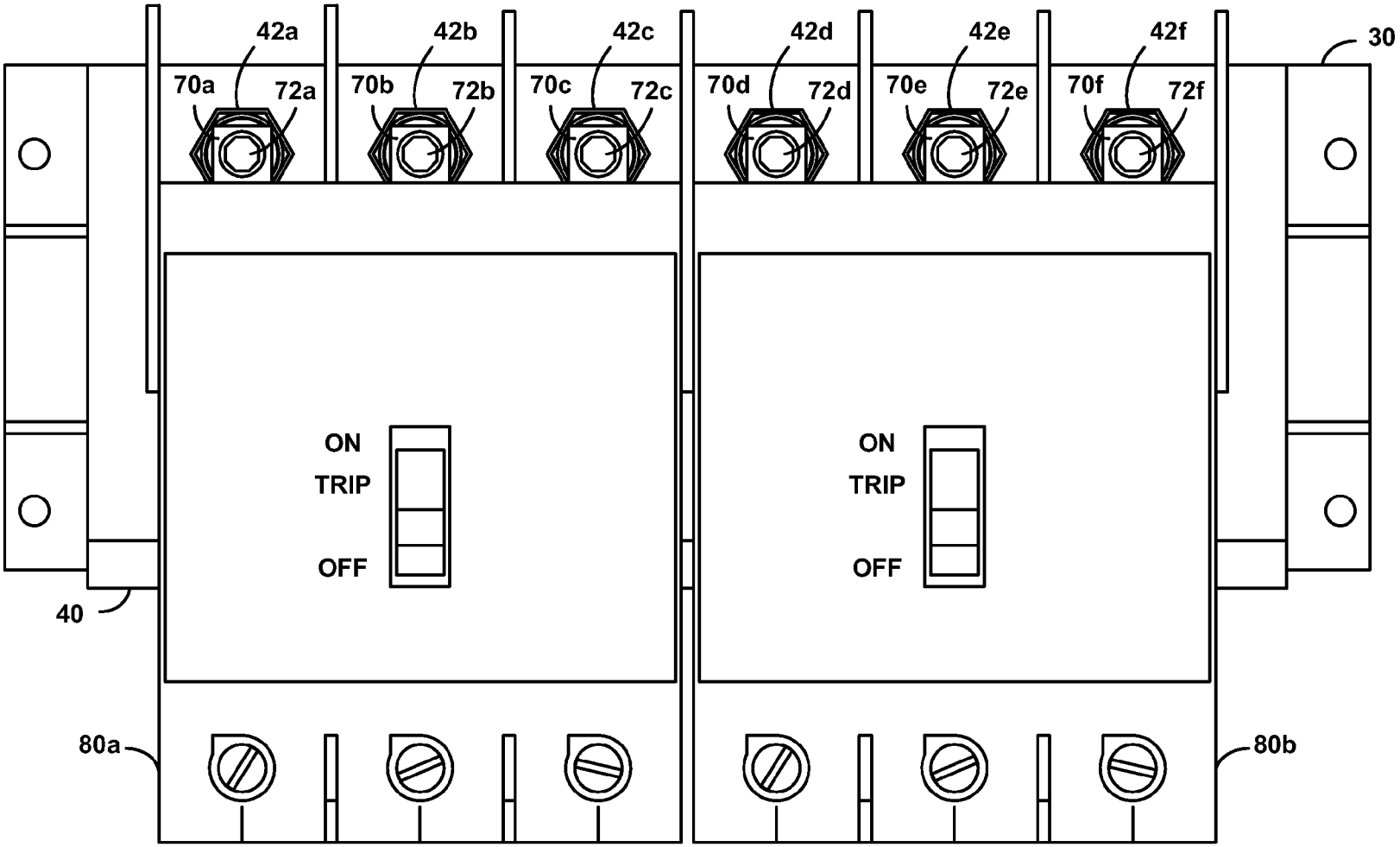

As mentioned above, example circuit breaker base 30, may be used with one or more single-pole, two-pole, three-pole, or other similar circuit breakers. For example, FIGS. 3C-3D illustrate an alternative example configuration in which conductive adapters 10*a*-10*f* are inserted into apertures 42*a*-42*f*, respectively, of circuit breaker base 30, and two, three-pole circuit breakers 80*a* and 80*b* are mounted on circuit breaker base 30 and coupled to conductive adapters 10*a*-10*c* and 10*d*-10*f*, respectively.

Circuit breaker 80*a* may include conductive tabs 70*a*-70*c* that are coupled to poles ϕa-ϕc, respectively, of circuit breaker 80*a*, and circuit breaker 80*b* may include conductive tabs 70*d*-70*f* that are coupled to poles ϕd-ϕf, respectively, of circuit breaker 80*b*. Conductive tabs 70*a*-70*f* may be copper, or other similar conductive material. Fasteners 72*a*-72*f* are inserted into openings in conductive tabs 70*a*-70*f*, respectively, and into internally threaded bores 22*a*-22*f*, respectively, of conductive adapters 10*a*-10*f*, respectively. Fasteners 72*a*-72*f* may be bolts, screws, or other similar fasteners.

Circuit breakers 80*a* and 80*b* each may include a recess (not shown) that engages and rests on raised lip 40 of circuit breaker base 30. Although not shown in FIGS. 3C-3D, conductors may be coupled to shanks 16*a*-16*f* of conductive adapters 10*a*-10*f*, respectively, to make line-side connections to poles ϕa-ϕf, respectively, of circuit breakers 80*a* and 80*b*.

Circuit breaker base 30 may be fabricated from a thermally insulative material, and apertures 42*a*-42*f* may be sized to have wall thicknesses to substantially prevent heat from escaping from conductive adapters 10 into the power distribution enclosure (not shown) in which circuit breaker base 30 may be mounted.

Figure 3E:
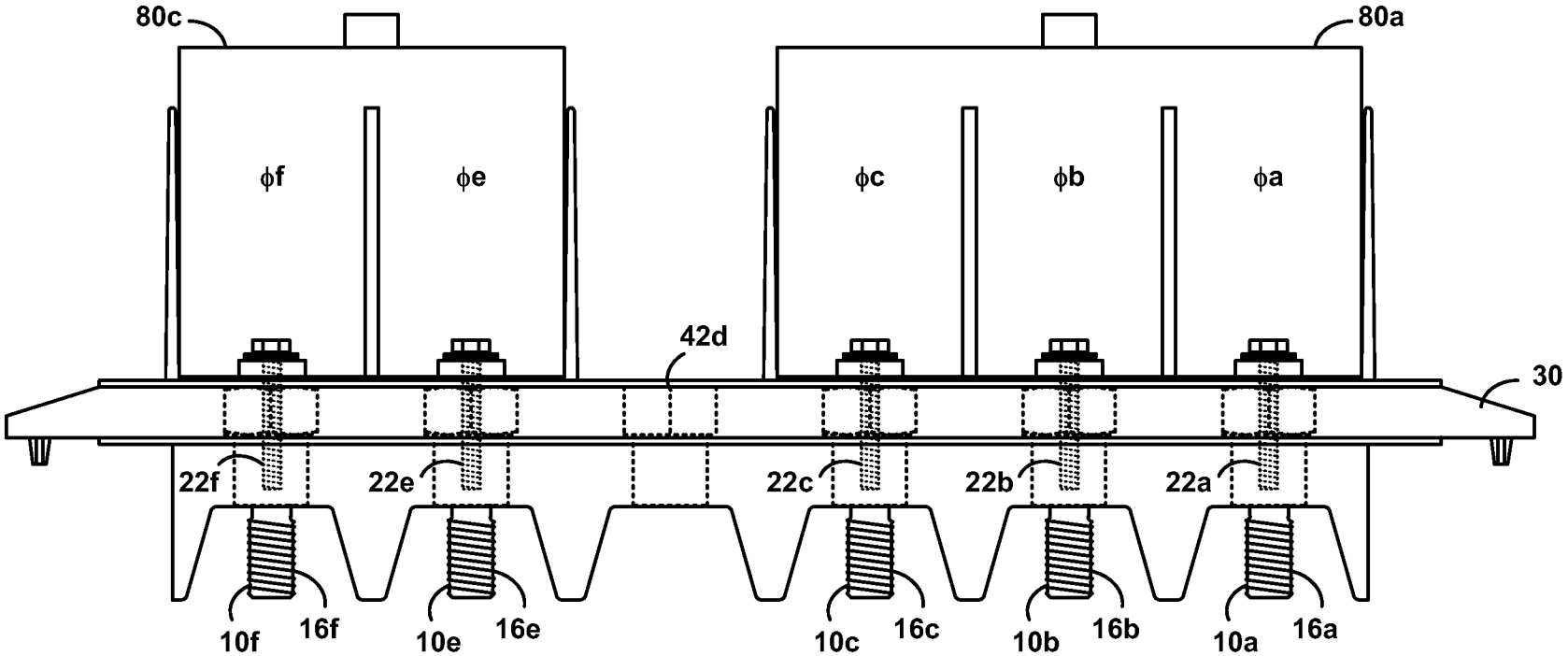
Figure 3F:
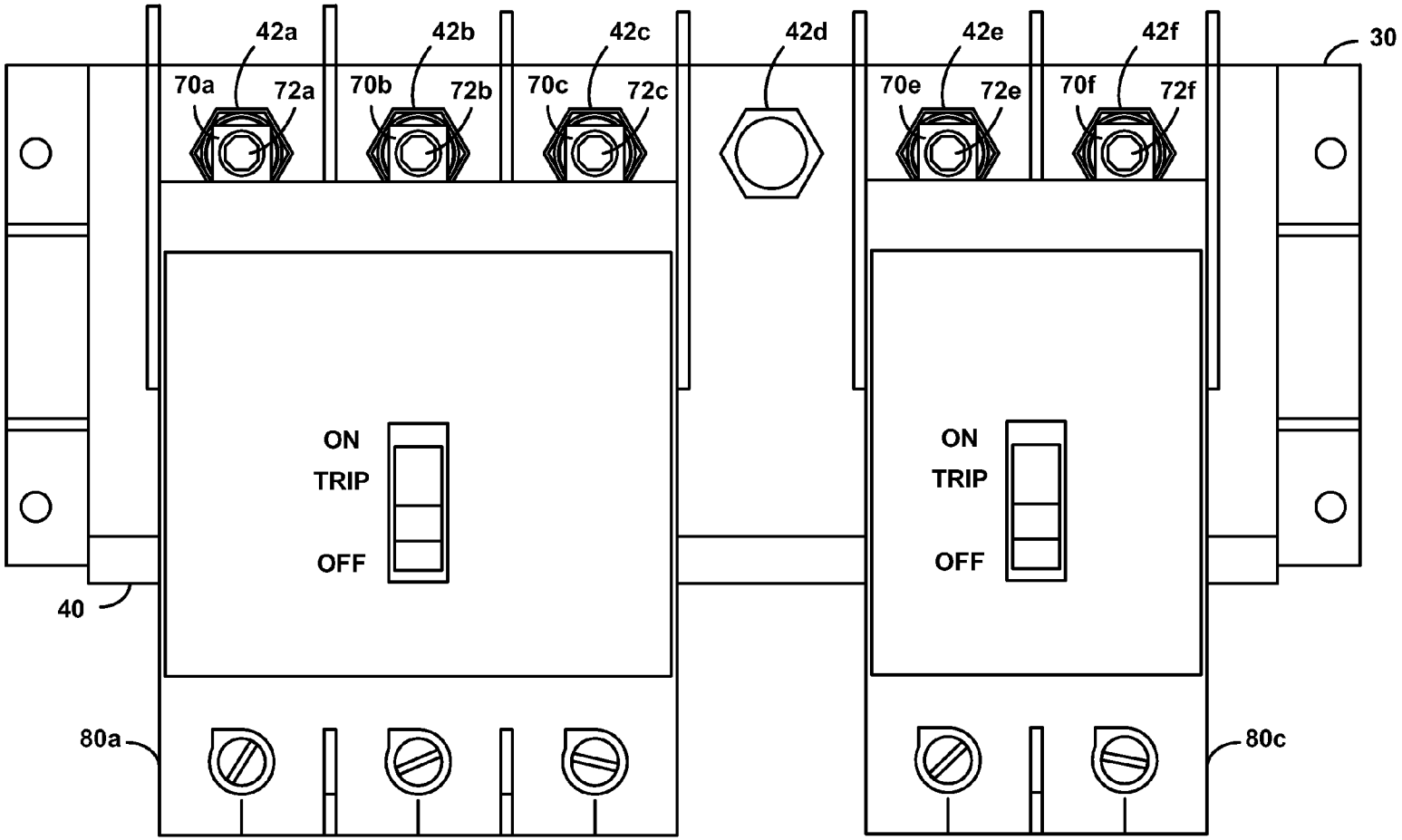

FIGS. 3E-3F illustrate another alternative example configuration in which conductive adapters 10*a*-10*c* and 10*e*-10*f* are inserted into apertures 42*a*-42*c* and 42*e*-42*f*, respectively, of circuit breaker base 30, and three-pole circuit breaker 80*a* and two-pole circuit breaker 80*c* are mounted on circuit breaker base 30 and coupled to conductive adapters 10*a*-10*c* and 10*e*-10*f*, respectively.

Circuit breaker 80*a* may include conductive tabs 70*a*-70*c* that are coupled to poles ϕa-ϕc, respectively, of circuit breaker 80*a*, and circuit breaker 80*c* may include conductive tabs 70*e*-70*f* that are coupled to poles ϕe-ϕf, respectively, of circuit breaker 80*c*. Conductive tabs 70*a*-70*c* and 70*e*-70*f* may be copper, or other similar conductive material. Fasteners 72*a*-72*c* and 72*e*-72*f* are inserted into openings in conductive tabs 70*a*-70*c* and 70*e*-70*f*, respectively, and into internally threaded bores 22*a*-22*c* and 22*e*-22*f*, respectively, of conductive adapters 10*a*-10*c* and 10*e*-10*f*, respectively. Fasteners 72*a*-72*c* and 72*e*-72*f* may be bolts, screws, or other similar fasteners.

Circuit breakers 80*a* and 80*c* each may include a recess (not shown) that that engages and rests on raised lip 40 of circuit breaker base 30. Although not shown in FIGS. 3E-3F, conductors may be coupled to shanks 16*a*-16*c* and 16*e*-16*f* of conductive adapters 10*a*-10*c* and 10*e*-10*f*, respectively, to make line-side connections to poles ϕa-ϕc and ϕe-ϕf, respectively, of circuit breakers 80*a* and 80*c*.

In addition to the examples illustrated in FIGS. 3A-3F and described above, persons of ordinary skill in the art will understand that conductive adapter 10 and example circuit breaker base 30 may be flexibly used with a variety of numbers and combinations of circuit breakers. Also, although example circuit breaker base 30 includes six apertures 42*a*-42*f*, and can accommodate from one to six circuit breakers, persons of ordinary skill in the art will understand that circuit breaker bases in accordance with this invention may include more or less than six apertures 42*a*-42*f*, and can accommodate more or less than one to six circuit breakers.

Figure 4B:
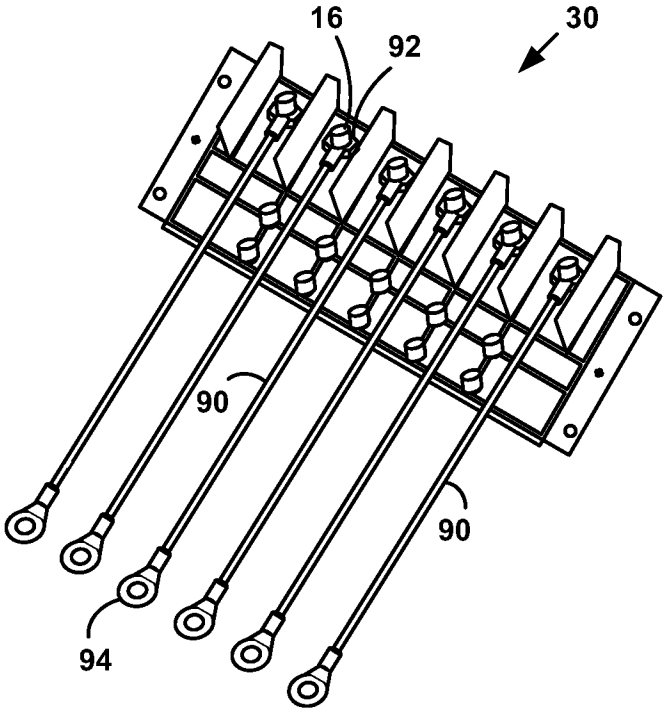
FIGS. 4A-4B are views of additional example configurations in accordance with this invention of the circuit breaker base of FIGS. 2A-2D.
Figure 4A:
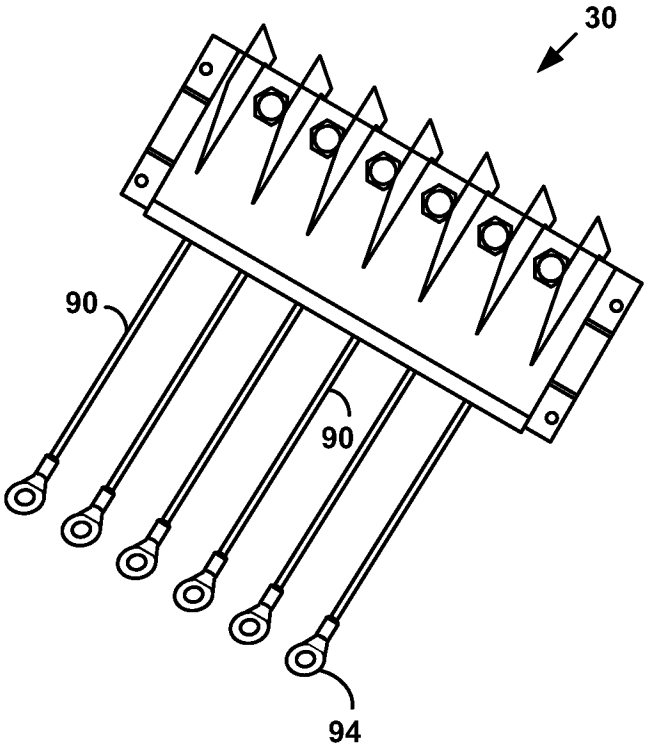

As described above in connection with FIGS. 3A-3F, conductors may be coupled to shanks 16*a*-16*f* of conductive adapters 10*a*-10*f*, respectively, to make line-side connections to circuit breakers coupled to conductive adapters 10*a*-10*f*. Examples of such conductors 90 are shown in FIGS. 4A-4B. In particular, any number of conductors 90 are coupled at a first end to shanks 16 with fasteners 92, such as nuts or other similar fasteners. Conductors 90 may include a ring or alternate end termination 94 for coupling conductors 90 to external circuitry (not shown).

Figure 5B:
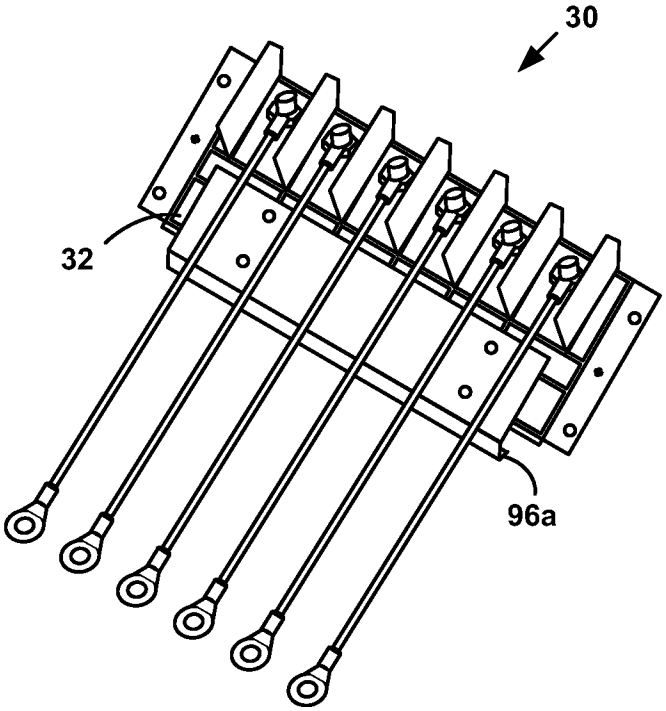
FIGS. 5A-5D are views of example accessories that may be used in accordance with this invention with the circuit breaker base of FIGS. 2A-2D.
Figure 5A:
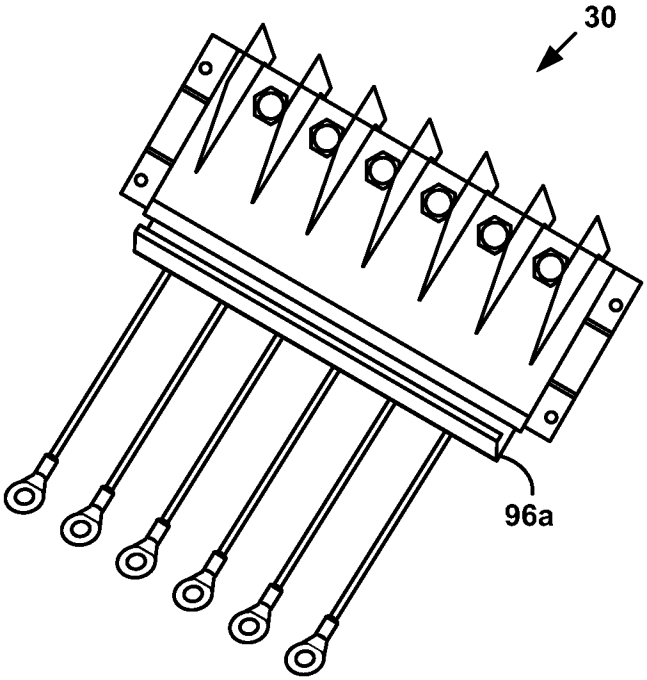
Figure 5D:
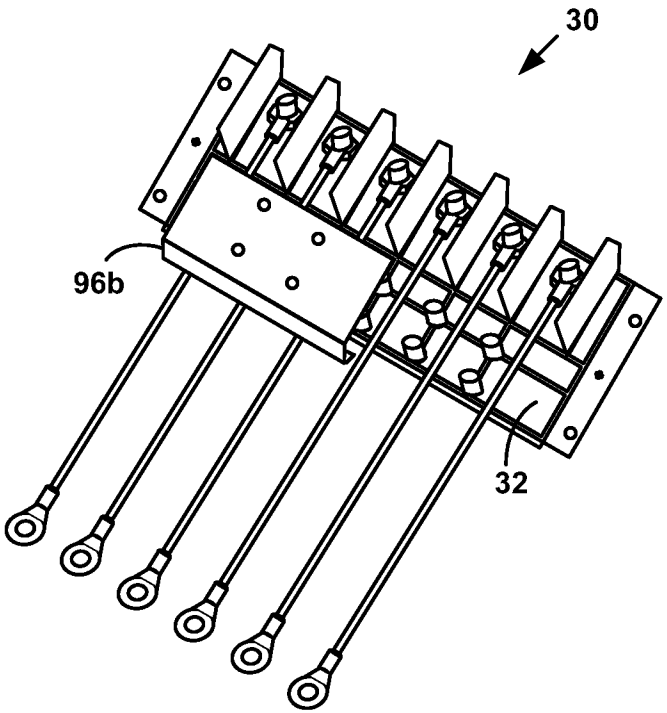
Figure 5C:
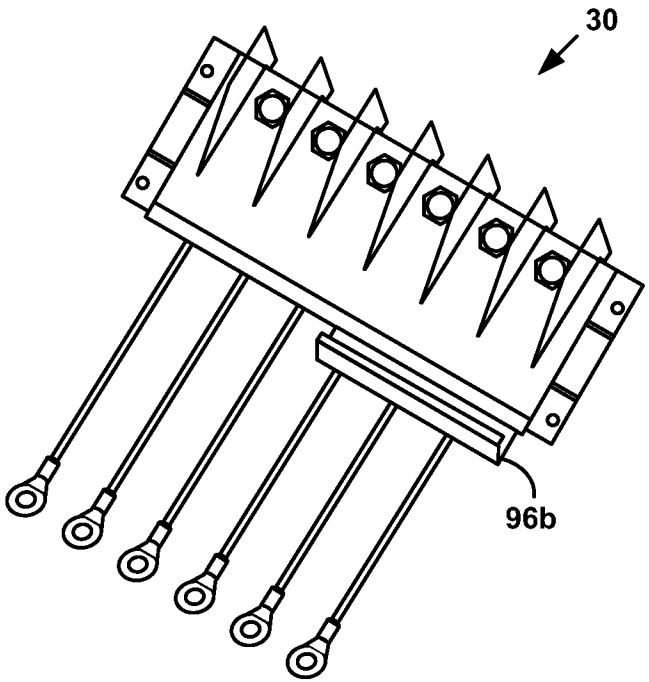

As described above, accessories may be attached to tray 32 of circuit breaker base 30 in accordance with this invention. For example, as shown in FIGS. 5A-5B, a circuit breaker bracket accessory 96*a* may be attached to tray 32 to accommodate a variety of different circuit breaker types, Circuit breaker bracket accessory 96*a* may be a full-width bracket that spans the entire width of circuit breaker base 30. Alternatively, as shown in FIGS. 5C-5D, circuit breaker bracket accessory 96*b* may be a half-width bracket that spans half the width of circuit breaker base 30. Persons of ordinary skill in the art will understand that various other accessory sizes and configurations may be used.

Neutral Bracket

Figure 6A:
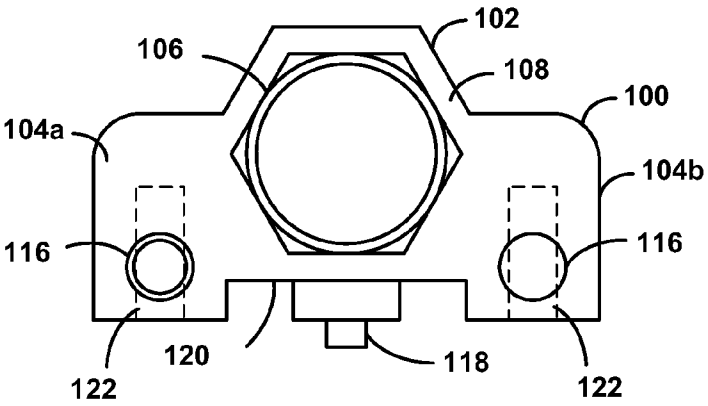
FIGS. 6A-6C are views of an example neutral bracket in accordance with this invention.
Figure 6B:
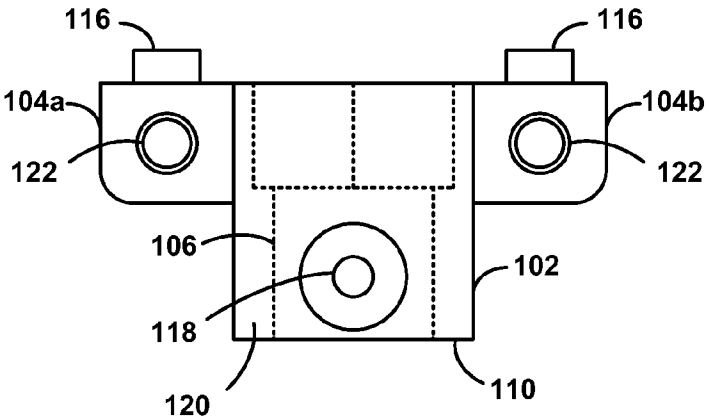
Figure 6C:
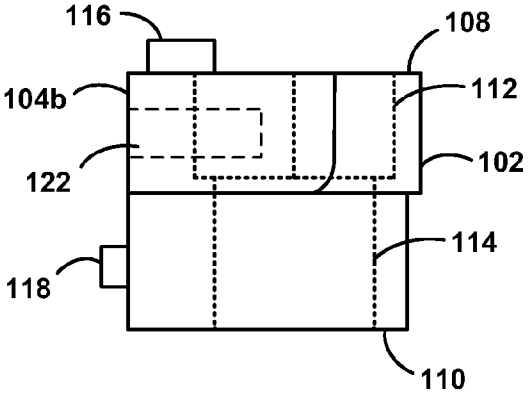

Referring to FIGS. 6A-6C, an example neutral bracket 100 in accordance with this invention is described. Neutral bracket 100 includes a shaft 102, a first arm 104*a* and a second arm 104*b*. Shaft 102 includes an aperture 106 that extends from a top side 108 to a bottom side 110 of shaft 102. Aperture 106 has a size and shape adapted to receive a conductive adapter 10 (FIGS. 1A-1C).

For example, aperture 106 has a first portion 112 having a hexagonal shape adapted to receive hexagonal head 12, and a second portion 114 having a cylindrical shape adapted to receive cylindrical shaft 14. Aperture 106 is sized so that head 12 and cylindrical shaft 14 snugly fit first portion 112 and second portion 114, respectively. In this regard, a conductive adapter 10 may be press-fit into aperture 106 without falling out, which may facilitate single handed insertion of a conductive adapter 10 into aperture 106. In addition, the shape of first portion 112 and second portion 114 substantially prevents rotation of an inserted conductive adapter 10.

Neutral bracket 100 optionally includes projections 116 disposed on top side 108 of first arm 104*a* and second arm 104*b*, and a stepped projection 118 disposed on a front side 120 of shaft 102. Projections 118 and 120 may be used to align neutral bracket 100 within a power distribution enclosure, such as a busway system including but not limited to busplugs, tap boxes, cubicles, transformer throats and other similar power distribution enclosures, or to other busway components (not shown). Neutral bracket 100 also may optionally include smooth or internally-threaded bores 122 that may be used to attach and secure neutral bracket 100 within a power distribution enclosure, such as a busway or other similar enclosure, or to other busway components (not shown).

Neutral bracket 100 preferably is fabricated from a high strength, electrically and thermally insulating material such as plastic, resin, reinforced plastic, ceramic, porcelain or other similar material. Neutral bracket 100 may be a single component, or may be made of multiple combined components, and may be fabricated by injection molding, machining, selective sintering or fusion, or other similar process.

Neutral bracket 100 may be fabricated in any desired dimensions. For example, neutral bracket 100 may have an overall length between about 1 cm and about 10 cm, an overall width between about 1 cm and about 10 cm, and an overall thickness between about 1 cm and about 10 cm. Persons of ordinary skill in the art will understand that other dimensions may be used. The geometry and insulating characteristics of neutral bracket 100 may be matched (e.g., tailored) to the determined geometry of conductive adapter 10, and subject to physical limits of the selected materials.

Conductive adapters and neutral brackets in accordance with this invention, such as example conductive adapter 10 and example neutral bracket 100, may be used together to physically and electrically couple conductors to one another, and align and attach the conductors within a power distribution enclosure, such as a busway or other similar enclosure, or to other busway components.

Figure 7:
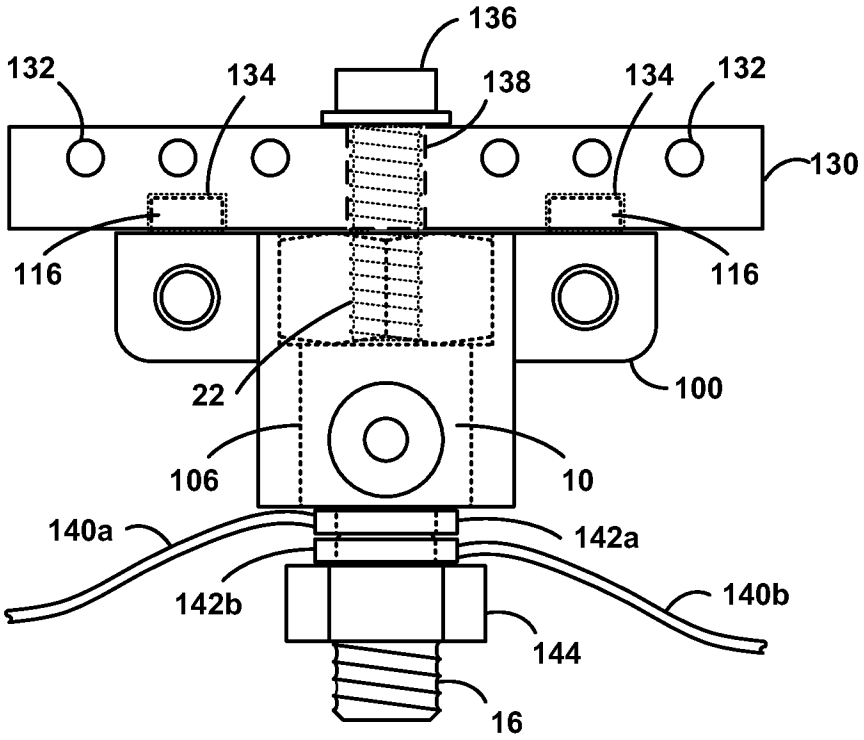
FIG. 7 is a view of example configuration in accordance with this invention of the conductive adapter of FIGS. 1A-1C and the neutral bracket of FIGS. 6A-6C.

For example, FIG. 7 illustrates an example configuration in which a conductive adapter 10 is inserted into aperture 106 of neutral bracket 100, which is coupled to a terminal block 130. Terminal block 130 includes one or more mounting ports 132 that may receive and secure terminal plugs of electrical conductors (not shown) to make electrical connection to terminal block 130.

Terminal block 130 also may include internal recesses 134 adapted to align with and receive projections 116 of neutral bracket 100. In this way, neutral bracket 100 and terminal block 130 may easily be coupled to one another. A fastener 136, such as a hex-headed bolt or other similar fastener, may be inserted through a bore 138 of terminal block 130 and into internally-threaded bore 22 of conductive adapter 10 to affix terminal block 130 to conductive adapter 10 and neutral bracket 100.

Insulated electrical conductors 140*a* and 140*b*, each terminate with conductive terminals 142*a* and 142*b*, respectively, which may be mounted on shank 16 of conductive adapter 10, and secured to conductive adapter 10 using a fastener 144, such as a hex-headed nut or other similar fastener. In this regard, conductors 140*a* and 140*b* and conductive adapter 10 are physically and electrically coupled to one another, and electrically coupled to terminal block 130. As a result, terminal ends of electrical conductors (not shown) may be inserted into mounting ports 132 of terminal block 130 to make electrical connection to conductors 140*a* and 140*b*.

Persons of ordinary skill in the art will understand that more or less than two conductors 140*a* and 140*b* may be coupled to shank 16 of conductive adapter 10, and also will understand that neutral bracket 100 alternatively may be coupled to components other than terminal block 130. The example shown in FIG. 7 is meant to provide a single example of how neutral bracket 100 may be configurably used to accommodate a variety of electrical components and provide various circuit configurations.

Neutral brackets in accordance with this invention may be selectively used individually or in combination as an isolated insulating terminal block or in electrical circuit combinations as a neutral, isolated ground or 200% neutral.

Neutral bracket 100 may be fabricated from a thermally insulative material, and aperture 106 may be sized to have a wall thickness to substantially prevent heat from escaping from conductive adapter 10 into the power distribution enclosure (not shown) in which neutral bracket 100 may be mounted.

The foregoing merely illustrates the principles of this invention, and various modifications can be made by persons of ordinary skill in the art without departing from the scope and spirit of this invention.

For example, the systems described above utilize circuit breakers. Persons of ordinary skill in the art will understand that one or more of conductive adapters, circuit breaker bases and neutral brackets in accordance with this invention alternatively may be used with other circuit protection devices, such as fuses, fused links, surge protectors. In addition, persons of ordinary skill in the art will understand that one or more of conductive adapters, circuit breaker bases and neutral brackets in accordance with this invention alternatively may be used with transformers, or other non-protective electrical devices.

The invention claimed is:

1. A system for a power distribution enclosure that includes an electronic circuit component, the system comprising:

a conductive adapter comprising a head and a shaft; and a circuit breaker base adapted for mounting to the power distribution enclosure, the circuit breaker base comprising:

an aperture through a first portion of the circuit breaker base, the aperture adapted to receive the head and the shaft of the conductive adapter, a first engagement feature disposed on a second portion of the circuit breaker base, the second portion opposite the first portion, the first engagement feature adapted to engage a recess on a back side of a circuit breaker, and a second engagement feature included on the circuit breaker base, the second engagement feature adapted for mounting to the power distribution enclosure, wherein:

the head of the conductive adapter has a shape that substantially prevents rotation of the conductive adapter when the conductive adapter is inserted into the aperture, the conductive adapter is configured to draw away or absorb heat from the electronic circuit component and move the absorbed heat out of the power distribution enclosure, and the circuit breaker base comprises an insulating material adapted to substantially prevent heat from escaping from the conductive adapter into the power distribution enclosure.

2. The system of claim 1, wherein the shape of the head is triangular, quadrilateral, pentagonal, hexagonal, octagonal, or polygonal.

3. The system of claim 1, wherein the conductive adapter further comprises a cylindrical or polygonal shaped shaft adjacent the head.

4. The system of claim 3, wherein the conductive adapter further comprises an internally-threaded bore that extends through the head and through a portion of the shaft.

5. The system of claim 3, wherein the conductive adapter further comprises a shank that has external threads and the cylindrical or polygonal shaped shaft is located between the shank and the head.

6. The system of claim 1, wherein the conductive adapter comprises one or more of copper, bronze, aluminum, brass, stainless steel, gold, silver, or platinum.

7. The system of claim 1, wherein the conductive adapter is plated with one or more of gold, silver, zinc, and/or tin.

8. The system of claim 1, wherein the circuit breaker base comprises a plurality of apertures including the aperture.

9. The system of claim 8, wherein each aperture has a first portion adapted to receive the head of the conductive adapter, and a second portion adapted to receive a shaft of the conductive adapter.

10. The system of claim 9, wherein the first portion and the second portion of each aperture is sized so that the head and the shaft of the conductive adapter snugly fit the first portion and the second portion of the aperture.

11. The system of claim 1, wherein the insulating material is an electrically and thermally insulating material.

12. The system of claim 1, wherein the circuit breaker base is adapted to receive one or more circuit breakers coupled to a corresponding one or more conductive adapters.

13. A system for a power distribution enclosure, the system comprising:

a conductive adapter comprising a head; and a neutral bracket comprising:

a first arm and an opposing second arm that are adapted for mounting to the power distribution enclosure, coupling features adapted for coupling to a terminal block, and an aperture disposed between the first arm and the second arm, the aperture adapted to receive the head of the conductive adapter, wherein:

the head of the conductive adapter has a shape that substantially prevents rotation of the conductive adapter when the conductive adapter is inserted into the aperture, and the neutral bracket comprises an insulating material adapted to substantially prevent heat from escaping from the conductive adapter into the power distribution enclosure.

14. The system of claim 13, wherein the shape of the head is triangular, quadrilateral, pentagonal, octagonal, or polygonal.

15. The system of claim 13, wherein the conductive adapter further comprises a cylindrical or polygonal adapter shaft adjacent the head.

16. The system of claim 15, wherein the neutral bracket includes a bracket shaft, and the aperture extends from a top side to a bottom side of the bracket shaft.

17. The system of claim 15, wherein the aperture has a first portion adapted to receive the head of the conductive adapter, and a second portion adapted to receive the adapter shaft of the conductive adapter.

18. The system of claim 13, wherein the insulating material is an electrically insulating material.

19. A method of configuring a power distribution enclosure that includes an electronic circuit component, the method comprising:

providing a plurality of conductive adapters, each conductive adapter comprising a head and a shaft;

providing a circuit breaker base comprising:

a plurality of apertures through a first portion of the circuit breaker base, each aperture adapted to receive the head and the shaft of one of the conductive adapters, a first engagement feature disposed on a second portion of the circuit breaker base, the second portion opposite the first portion, the first engagement feature adapted to engage a recess on a back side of one or more circuit breakers, and a second engagement feature included on the circuit breaker base, the second engagement feature adapted for mounting to the power distribution enclosure, inserting one or more of the conductive adapters into a corresponding one or more of the apertures, wherein the head of each conductive adapter has a shape that substantially prevents rotation of the conductive adapter in the aperture; and mounting the circuit breaker base using the second engagement feature to the power distribution enclosure, wherein:

the conductive adapters are configured to draw away or absorb heat from the electronic circuit component and move the absorbed heat out of the power distribution enclosure, and the circuit breaker base comprises an insulating material adapted to substantially prevent heat from escaping from the conductive adapters into the power distribution enclosure.

20. The method of claim 19, further comprising coupling the one or more circuit breakers to a corresponding one or more of the conductive adapters.

21. A system for a power distribution enclosure that includes an electronic circuit component, the system comprising:

a conductive adapter comprising a head, a shank that has external threads and a shaft located between the shank and the head, an internally-threaded bore that extends through the head and through a portion of the shaft, and a fastener inserted into the internally threaded bore; and a circuit breaker base adapted for mounting to the power distribution enclosure, the circuit breaker base comprising an aperture adapted to receive the head and the shaft of the conductive adapter wherein the head of the conductive adapter has a shape that substantially prevents rotation of the conductive adapter when the conductive adapter is inserted into the aperture;

a circuit breaker mounted to the circuit breaker base, the circuit breaker including a conductive tab coupled to the conductive adapter by the fastener;

a conductor coupled to the shank of conductive adapter to make line-side connections to the circuit breaker; and the conductive adapter is configured to draw away or absorb heat from the electronic circuit component and move the absorbed heat out of the power distribution enclosure, and the circuit breaker base comprises an insulating material adapted to substantially prevent heat from escaping from the conductive adapter into the power distribution enclosure.

* * * * *